US006868872B2

(12) United States Patent
Fuchs

(10) Patent No.: US 6,868,872 B2
(45) Date of Patent: Mar. 22, 2005

(54) APPARATUS FOR COUPLING STACKED SHEETS

(75) Inventor: Ferdinand Fuchs, Nürtingen (DE)

(73) Assignee: Kugler-Womako GmbH, Nurtingen (DE)

( * ) Notice: Subject to any disclaimer, the term of this patent is extended or adjusted under 35 U.S.C. 154(b) by 0 days.

(21) Appl. No.: 10/396,705

(22) Filed: Mar. 26, 2003

(65) Prior Publication Data

US 2003/0183298 A1 Oct. 2, 2003

(30) Foreign Application Priority Data

Mar. 28, 2002 (DE) ..... 102 14 350

(51) Int. Cl.[7] ..... B21F 23/00
(52) U.S. Cl. ..... 140/92.93
(58) Field of Search ..... 140/92.3, 92.4, 140/92.93, 92.94, 92.9

(56) References Cited

U.S. PATENT DOCUMENTS 2,166,519 A * 7/1939 Catini ..... 140/92.93
2,603,246 A * 7/1952 Dockery ..... 140/92.9
2,630,145 A * 3/1953 Stevens ..... 140/92.3
3,134,406 A * 5/1964 Freundlich et al. ..... 140/92.3
4,378,822 A 4/1983 Morris
5,785,479 A 7/1998 Battisti et al.

FOREIGN PATENT DOCUMENTS

| | | |
|---|---|---|
| CH | 3 66 030 | 12/1962 |
| DE | 607 214 C | 12/1934 |
| DE | 1 801 965 B | 7/1970 |

* cited by examiner

*Primary Examiner*—Lowell A. Larson
(74) *Attorney, Agent, or Firm*—Venable LLP; Robert Kinbert; Catherine M. Voorhees

(57) ABSTRACT

Apparatus for introducing magnetic spirals into rows of neighboring perforations in the spines of stacks of overlapping sheets which are to form discrete calendars, memo pads or analogous commodities employs an elongated guide for a continuous magnetic coil spring. The coil spring is rotated about its longitudinal axis and is moved lengthwise so that its convolutions enter successive perforations of the row of perforations in the stack being held in the guide. The guide embodies or cooperates with magnets which maintain the convolutions of the coil spring in the path defined therefor by the guide. The magnets can be embedded in antimagnetic tubes forming part of or constituting the guide.

18 Claims, 6 Drawing Sheets

1
3
4
6
7
8
9
11
12
14
16
17
18
19
21
22
23
24

1
2
6
26
27
28
29
32
33
34
35
36
37
38

1
2
6
26
28
29

APPARATUS FOR COUPLING STACKED SHEETS

CROSS-REFERENCE TO RELATED CASES

The present application claims the priority of the commonly owned German patent application Serial No. 102 14 350.1 filed Mar. 28, 2002. The disclosures of the aforementioned German priority application as well as of each US and foreign patent and patent application identified in the specification of the present application are incorporated herein by reference.

BACKGROUND OF THE INVENTION

This invention relates to improvements in apparatus for stacking sheets, e.g., sheets of paper, plastic or cardboard and/or the like, by means of helical connectors such as coil springs. Typical examples of commodities which can be turned out by resorting to the apparatus of the present invention are pads of overlapping cardboard and/or paper sheets which can be held together by a length of coil spring in such a way that the individual sheets or groups of sheets can be pivoted relative to the other sheets or groups of sheets along one marginal portion of the pad, namely along a marginal portion provided with a row of registering holes or perforations for discrete convolutions of the length of coil spring.

Conventional apparatus of the above outlined character are provided with a guide which is intended to control the position of the coil spring during threading of its convolutions into successive sets of overlapping holes in one marginal portion of the stack or pile of sheets which are to be pivotally connected to each other. The coil spring is moved lengthwise of the one marginal portion and is turned about its axis so that successive convolutions enter successive sets of overlapping holes; the ends of the fully introduced coil spring are thereupon deformed and/or otherwise enlarged at the two ends of the row of sets of overlapping holes.

The just described conventional apparatus normally form part of a semiautomatic or automatic production line which is designed to turn out pads and similar commodities wherein the sheets are held together by coil springs made of metal or plastic material. The production line can further comprise suitable means for converting large panels or webs of paper, plastic and/or cardboard into sheets of desired size and shape, for assembling the thus obtained sheets into stacks of desired thickness (i.e., into stacks each of which contains a predetermined number of identical or different sheets), and for providing one marginal portion (namely the so-called spine) of each stack with a row of perforations. The thus obtained and treated stacks are ready to receive coil springs (hereinafter called spirals for short) which are designed to hold the sheets together but to permit the sheets to pivot relative to one another along the spine of the respective pad. The aforedescribed production line can further comprise means for providing certain sheets (such as the cover and/or the back sheet) with printed matter and/or other information.

The spiral of each of a series of successive pads can form part of a continuous coil spring which is severed as soon as a requisite length thereof has been threaded through the stacks of holes in a pad, and the end portions of the severed part of the continuous coil spring are thereupon bent and/or otherwise deformed or enlarged so that the spiral remains confined in the thus finished pad. The perforations or holes can be provided in the panels or in the web prior to their subdivision into discrete sheets, or subsequent to assembly of requisite numbers of sheets into stacks. Accurate alignment of perforations in each sheet of a pad with the perforations of the neighboring sheets is highly desirable in order to facilitate and simplify predictable threading of convolutions of a continuous coil spring into the rows of perforations in the sheets of each stack.

The threading of a continuous cylindrical coil spring into the rows of holes or perforations in successive stacks involves a turning and simultaneous lengthwise advancement of the coil spring. The rate of lengthwise movement of the continuous coil spring is related to the lead or pitch of its convolutions. Accurate guidance of the advancing and rotating continuous coil spring is important because this contributes to the quality of the pads as well as to the frequency at which the production line turns out acceptable pads. The number of rejects is directly related to the accuracy at which the continuous coil spring is being advanced during threading of its convolutions into the rows of overlapping perforations in successive stacks of sheets.

It is further important to properly select the lead or pitch of the convolutions which form the continuous coil spring. The leader of the advancing coil spring is likely to bend away from the prescribed path if the lead or pitch of its convolutions is too small. Alternatively, an intermediate portion of the advancing continuous coil spring exhibits a tendency to buckle or bend if the lead or pitch of the convolutions is excessive. The purpose of the aforementioned guide means is to prevent the aforedescribed and/or other stray movements of the advancing continuous coil spring, a task which cannot be carried out in a fully satisfactory manner with presently known guide means, especially if the continuous coil spring is to advance at an elevated speed as required in production lines which are intended to turn out huge quantities of finished commodities per unit of time.

OBJECTS OF THE INVENTION

An object of the present invention is to provide an apparatus for making spirals-containing pads with novel and improved means for controlling the movements of spirals while the convolutions at the leaders of successive spirals are caused to advance toward and into the rows of stacked holes or perforations in successive stacks of sheets of paper, plastic, cardboard and/or the like.

Another object of the invention is to reduce the likelihood of bending and/or buckling of the continuous coil spring on its way toward and into the rows of stacked holes or perforations.

A further object of the instant invention is to provide a novel and improved apparatus for making pads or analogous commodities wherein stacks or piles of sheets and/or panels are pivotally connected to each other by the convolutions of elongated spirals of metallic wire.

An additional object of the invention is to provide a novel and improved method of controlling the movements of a continuous coil spring and/or discrete spirals in an apparatus of the above outlined character.

Still another object of the invention is to provide an apparatus which can turn out large quantities of spiral-containing pads per unit of time without increasing the number of rejects.

A further object of the invention is to provide an apparatus which can cooperate with presently known arrangements for making continuous coil springs consisting of helical convolutions and/or with presently known arrangements for assembling stacks of perforated sheets or sheets which are ready to be perforated.

SUMMARY OF THE INVENTION

The invention is embodied in an apparatus which can be utilized to introduce the convolutions of magnetic spirals into elongated rows of registering successive holes in stacks of superimposed sheets. The improved apparatus comprises guide means defining for the spirals a path extending longitudinally of the rows of holes, means for threading the convolutions of the spirals in a predetermined direction into successive holes of rows in the respective stacks, and magnetic means associated with the guide means for maintaining the spirals in the aforementioned path.

At least some of the sheets can consist of paper, plastic and/or cardboard, and the spirals consist of a metallic material.

The path which is defined by the guide means can resemble an elongated trough which is bounded, at least in part, by a concave surface.

The guide means can include at least one elongated rotary roller which extends lengthwise of the path, and the magnetic means is or can be associated with the at least one roller. For example, at least a portion of the magnetic means can be at least partially confined in the at least one roller. Such magnetic means can comprise a plurality of discrete magnets in the at least one roller.

In accordance with a presently preferred embodiment, the guide means includes a plurality of at least substantially parallel elongated rotary rollers which extend lengthwise of the path, and such apparatus further comprises means for rotating the rollers in the same direction and at least substantially at identical speeds. The magnetic means is or can be associated with at least one of the rollers. Each of the magnetic spirals can have a predetermined diameter which is identical with the diameter of each other spiral, and the rollers can include first and second rollers which are spaced apart from each other a distance at least slightly less than the predetermined diameter.

The means for threading can comprise an elongated core which is surrounded by some convolutions of the spirals upstream of the path, as seen in the predetermined direction. Such apparatus preferably further comprises means for rotating the core and for advancing the core lengthwise in the predetermined direction. The core can include an at least substantially cylindrical mandrel. The means for rotating the core is or can be arranged to rotate the core at a first speed, and the guide means of such apparatus can include at least one elongated rotary roller and means for rotating the at least one roller at a second speed exceeding the first speed.

The magnetic means can comprise at least one row of successive neighboring magnets which extend longitudinally of the path, and the neighboring magnets of the at least one row preferably have identical poles adjacent each other. The magnets of the at least one row are or can be at least substantially identical with each other. Furthermore, the magnets of the at least one row are or can be at least substantially equidistant from each other.

As already mentioned hereinbefore, the magnetic means can include a plurality of magnets which are confined in the guide means, and such guide means can include at least one antimagnetic envelope which at least partially confines the plurality of magnets. Such envelope can include a tube, and the magnets of the plurality of magnets can form a row of spaced-apart magnets in the tube.

The guide means can include at least one elongated roller having an external helical groove for portions of convolutions of spirals in the path.

The apparatus can further comprise or cooperate with means for stacking the sheets and with means for supplying stacked sheets to the path.

The guide means can further comprise at least one elongated auxiliary guide bounding a portion of the path and having a series of projections (e.g., in the form of pins) extending between the convolutions of a spiral in the path.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figures 1A, 2A:
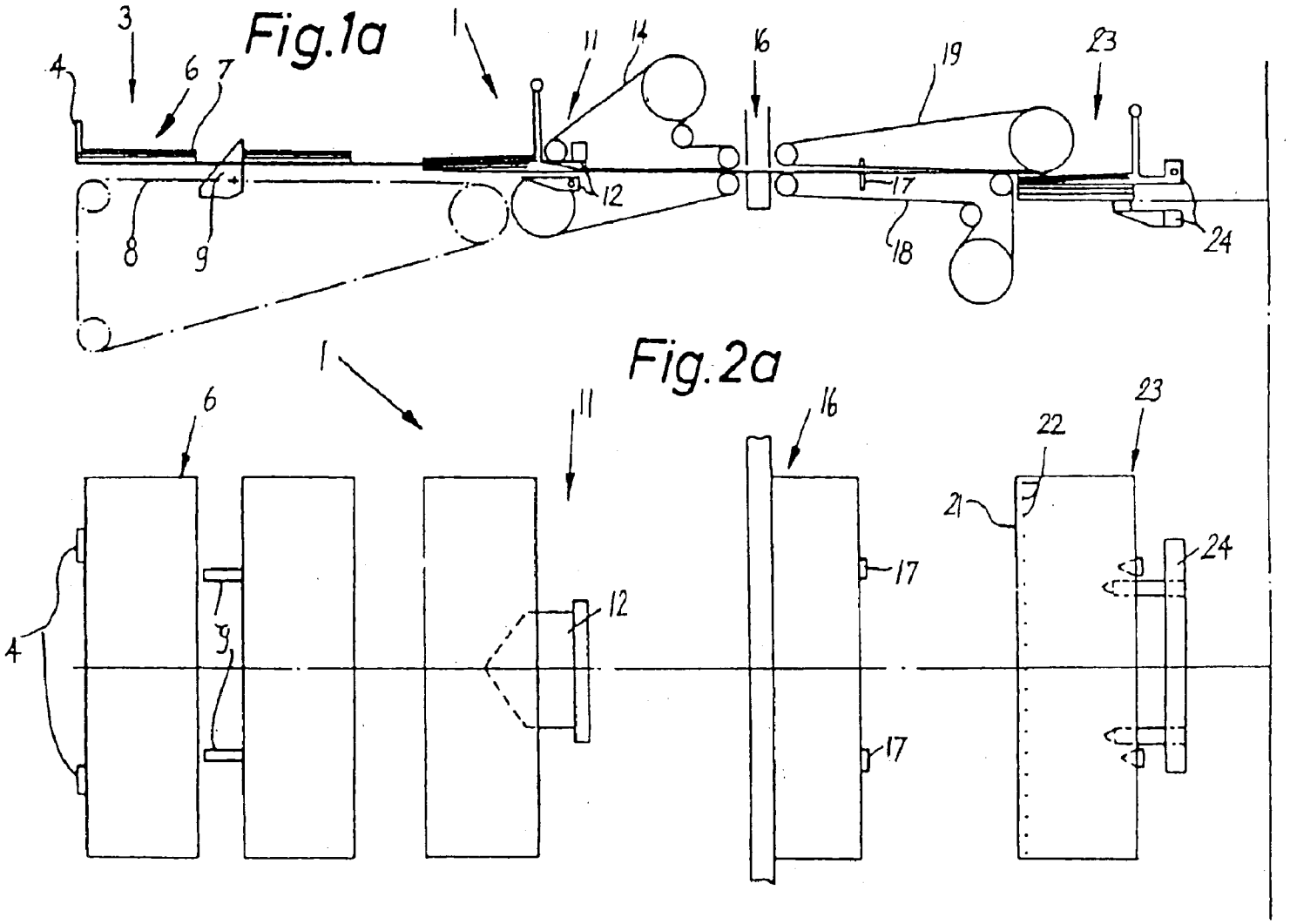
FIG. 1*a* is a schematic side elevational view of those parts of the improved apparatus which gather sheets into successive stacks ready to be provided with magnetic spirals in accordance with the present invention.
FIG. 2*a* is a schematic plan view of the structure which is shown in FIG. 1*a;*

FIGS. 1*a*, 1*b*, 2*a* and 2*b* show a production line which includes an apparatus 36 embodying the present invention as well as means for stacking sheets and means for supplying stacked sheets to the improved apparatus. The sheets are assumed to consist of paper, e.g., ruled paper which can form part of memo pads. However, it is equally within the purview of the present invention to form, assemble (stack) and further process sheets, panels or foils which consist of metal, cardboard and/or plastic material and are to form part of pads, calendars, brochures or analogous commodities. For the sake of simplicity and brevity, the constituents of stacks which are to be treated in accordance with the present invention will be referred to as sheets.

The improved production line includes a straight or substantially straight first section or unit 1 wherein large panels 7 are gathered into piles 6 each having a predetermined number of superimposed (overlapping) panels, and a second section or unit 2 wherein successive rows of four stacks 29 each are conveyed along an arcuate path toward, through and beyond the apparatus 36. The unit 1 comprises a receiving station 3 for successive piles 6 of superimposed panels 7. Such piles can be delivered by hand or by a suitable machine or conveyor (not shown) in such a way that their trailing edges abut a stop 4. Each panel 7 can constitute a strip (see FIGS. 2*a* and 2*b*) having a width and/or length which is a multiple of (such as four times) the corresponding dimension of a sheet of the ultimate product.

The means for advancing piles 6 of panels 7 from the station 3 comprises an endless belt, band or chain conveyor 8 having spaced-apart pairs of pushers 9 (one pair shown in each of FIGS. 1*a* and 2*a*) which engage and entrain successively assembled or deposited piles 6. The conveyor 8 can be driven continuously or intermittently and supplies successive piles 6 to a subdividing station 11 for tongs 12 or other suitable means serving to subdivide each pile 6 into several at least substantially identical (thinner) piles of superimposed panels. Successive (thinner) piles are engaged by two endless (lower and upper) belt or band conveyors 13, 14 which deliver the piles to a perforating unit 16. The latter extends transversely of the direction of advancement of the piles with the conveyors 13, 14 and cooperates with an adjustable stop 17 disposed between the neighboring reaches of two endless belt or band conveyors 18, 19. The stop 17 arrests successive piles in such positions that their trailing edges (spines) 21 are held in optimum positions for the making of rows of perforations or holes 22 (see the right-hand portion of FIG. 2*a*).

The conveyors 18, 19 advance successive piles of freshly perforated panels 7 to a gathering station 23 wherein the piles are stacked on top of each other to their original thicknesses (corresponding to those of the piles being advanced by the pusher 9 of the conveyor 8) with the exception that the spine 21 of each such reassembled pile is provided with a row of perforations 22.

Figure 1B:
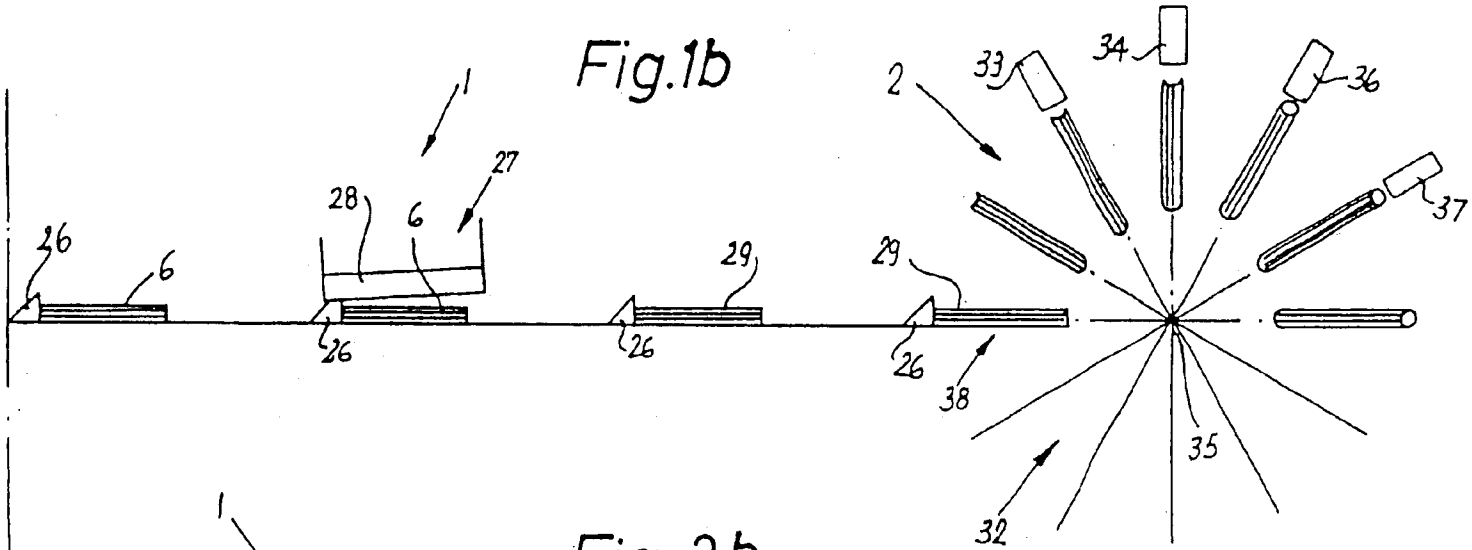
FIG. 1*b* is a similar side elevational view of that portion of the improved apparatus which introduces spirals into the rows of perforations provided in the spines of successive stacks of sheets.
Figure 2B:
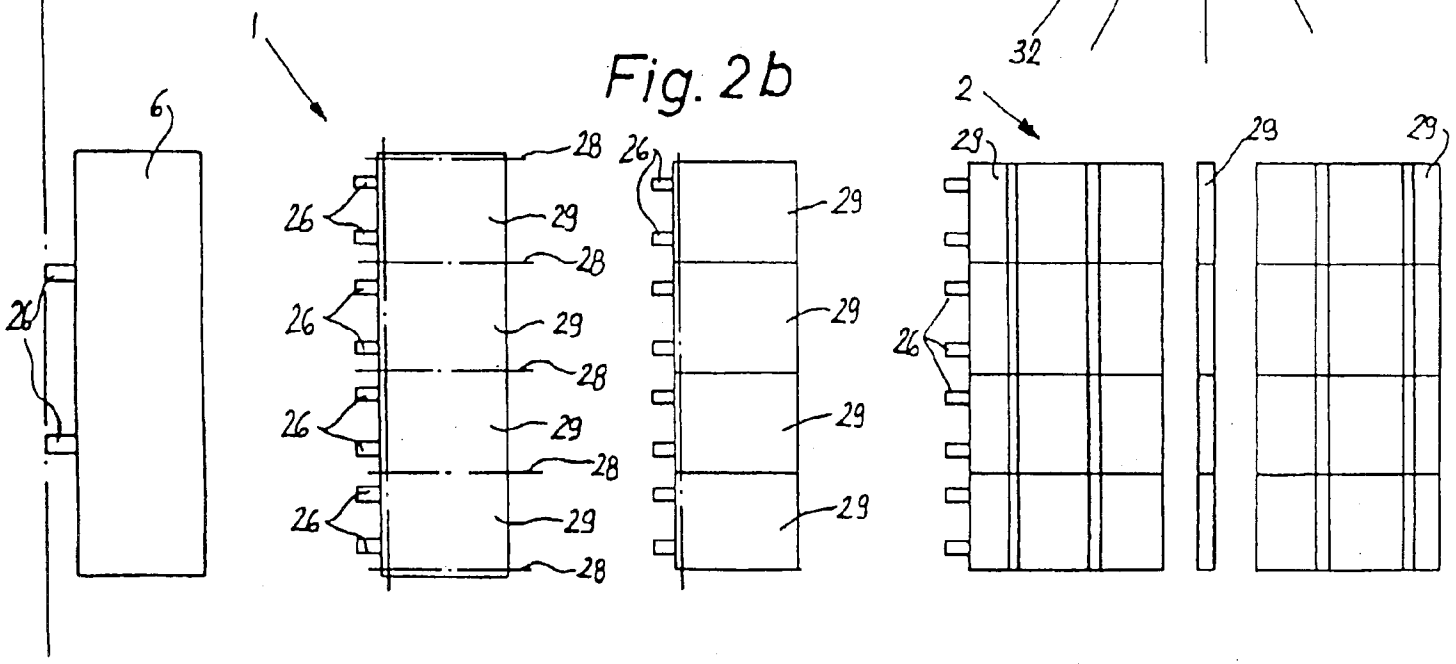
FIG. 2*b* is a schematic plan view of the structure which is shown in FIG. 1*b;*

An adjustable tongs 24 is provided to withdraw successive perforated piles 6 from the gathering station 23 to such an extent that they advance into the range of pushers 26 on the intermittently driven endless conveyor serving to advance successive piles to a severing unit 27 having knives 28 which extend in the direction of sidewise movement of perforated piles 6 and serve to subdivide each such pile into four identical stacks 29 (see FIGS. 1*b* and 2*b*). The pushers 26 advance the thus obtained groups or sets of four stacks 29 each into successive radial pockets 38 of an intermittently driven turret 32. The latter is indexible about an axis 35 (see FIG. 1*b*) which is normal to the direction of movement of piles and stacks with the conveyors, 8, 13–14, 18–19 and pushers 26, i.e. parallel to the rows of perforations 22 and the spines 21.

The turret 32 is set up to intermittently advance rows of perforated stacks 29 past a series of successive processing stations including the station accommodating the novel spiral introducing apparatus 36. These processing stations further include first and second orienting stations 33, 34 and a further station 37 downstream of the apparatus 36 as seen in the direction of indexing of the turret 32 (namely clockwise as seen in the right-hand portion of FIG. 1*b*).

Each pocket 38 is dimensioned to receive a row of four stacks 29, and each such pocket comprises two panels or cheeks flanking the row of stacks therein. At least one panel of each pocket 38 is movable relative to the other panel, e.g., by a linkage or by other suitable actuating means (not shown) which receives motion from one or more cams cooperating with the motor or other suitable means for indexing the turret 32. The panels of the pockets 38 are caused to permit introduction of rows or sets of four stacks 29 each at the station where the unit 1 delivers successive sets of stacks 29 to the unit 2 (i.e., to the turret 32) and, if necessary, at the orienting station 33 and/or 34 in order to permit or to cause adjustments in the positions of successive sets of stacks 29 on their way to the apparatus 36.

Figure 3:
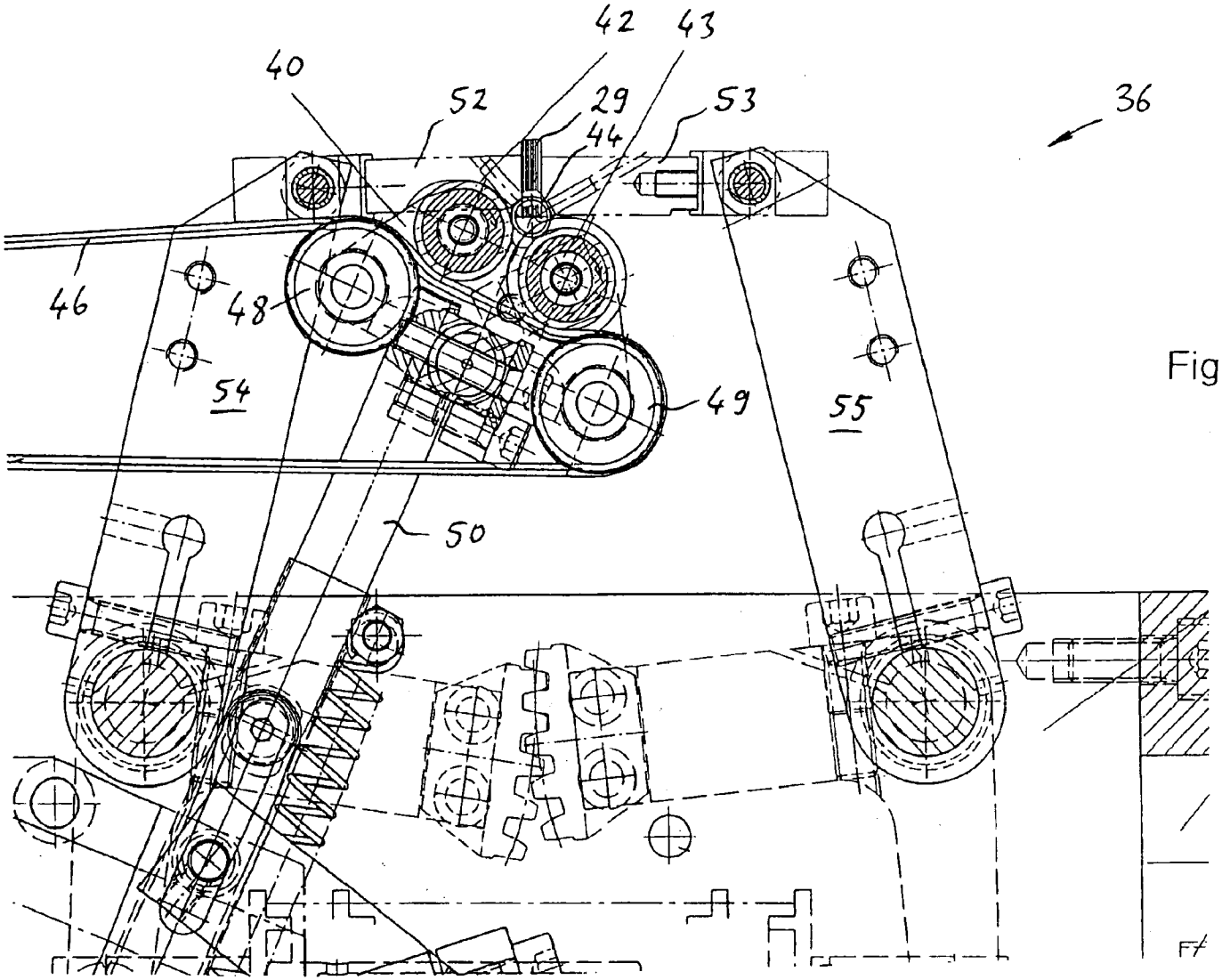
FIG. 3 is a greatly enlarged fragmentary partly front elevational and partly sectional view of that portion of the structure shown in FIGS. 1*a* and 1*b* which serves to thread successive sections of a continuous coil spring into the rows of perforations in successive stacks of overlapping sheets.

One presently preferred embodiment of the apparatus 36 is shown in FIG. 3. For the sake of clarity and better illustration, the orientation of the apparatus 36 in FIG. 1*b* departs from that of the same apparatus shown in FIG. 3. It will be noted that, in FIG. 1*b*, the apparatus 3*b* is installed at a level above the axis 35 of the turret 32. However, it is equally possible to install the apparatus at a level below such axis.

Referring now to FIG. 3 in detail, the apparatus 36 which is shown therein comprises a conventional spiral forming assembly 40 which is located at one side of the series of (four) stacks 29 at the threading station. The assembly 40 includes a guide means having two elongated rotary rollers 42, 43 (see also FIG. 4) defining a substantially concave elongated path for a series of successive coil springs or spirals 44 each consisting of or containing a magnetic (such as ferromagnetic) material and being caused to advance axially (arrow A in FIG. 4) as well as to rotate about its longitudinal axis, i.e., in parallelism with the axis 35 of the indexible turret 32. Such mode of manipulating the coil springs 44 relative to the guide rollers 42, 43 ensures that successive convolutions 44*a* of each coil spring are theaded into the perforations 22 of the respective one of the four stacks 29 then located at the station shown in FIGS. 3 and 4.

The rollers 42, 43 are parallel to and are spaced apart from each other a distance less than the diameters of the convolutions 44*a* of the coil spring 44. The diameter of the illustrated guide roller 42 matches that of the guide roller 43, and the length of each of these rollers can equal or even exceed the combined length of the four rows of perforations 22 in the stacks 29 occupying the (threading) station for the apparatus 36. However, it is also possible to employ four pairs of rollers 42, 43, one pair for each of the stacks 29 at the station accommodating the apparatus 36. This apparatus further comprises means (e.g., including an electric motor) for rotating the rollers 42, 43 in the same direction (see the arrows 42A, 43A in FIG. 4) and at the same peripheral speed. FIG. 3 shows a portion of an endless belt 46 which forms part of the rotating means and is driven by the aforementioned motor. FIG. 3 also shows two roll-shaped pushers 48, 49 which serve to respectively press the belt 46 against the rollers 42 and 43. The axes of the pushers 48, 49 are parallel to the axes of the guide rollers 42, 43. The pushers 48, 49 can be biased toward the respective rollers 42, 43 or they are installed in such close proximity to the respective rollers that they compress the adjacent portions of the belt 46 and thus maintain the belt in requisite frictional engagement with the rollers.

The spiral forming assembly 40 of FIG. 3 is mounted on a support 50 in such a way that the guide rollers 42, 43 are disposed between two jaws 52, 53 which clamp the stacks 29 at the spiral threading station of the apparatus 36 while the convolutions 44*a* of each coil spring 44 are being threaded into the perforations 22 of the respective stack 29 between the jaws 52, 53. These jaws are respectively mounted on pivotable arms 54, 55 which can be moved toward each other and apart by suitable actuating means. The support 50 is withdrawn when the arms 54, 55 are caused to move apart; this ensures that the apparatus 36 opens up so that the next group or row of four stacks 29, namely the group which has left the orienting station 34, can enter this apparatus.

Figure 4:
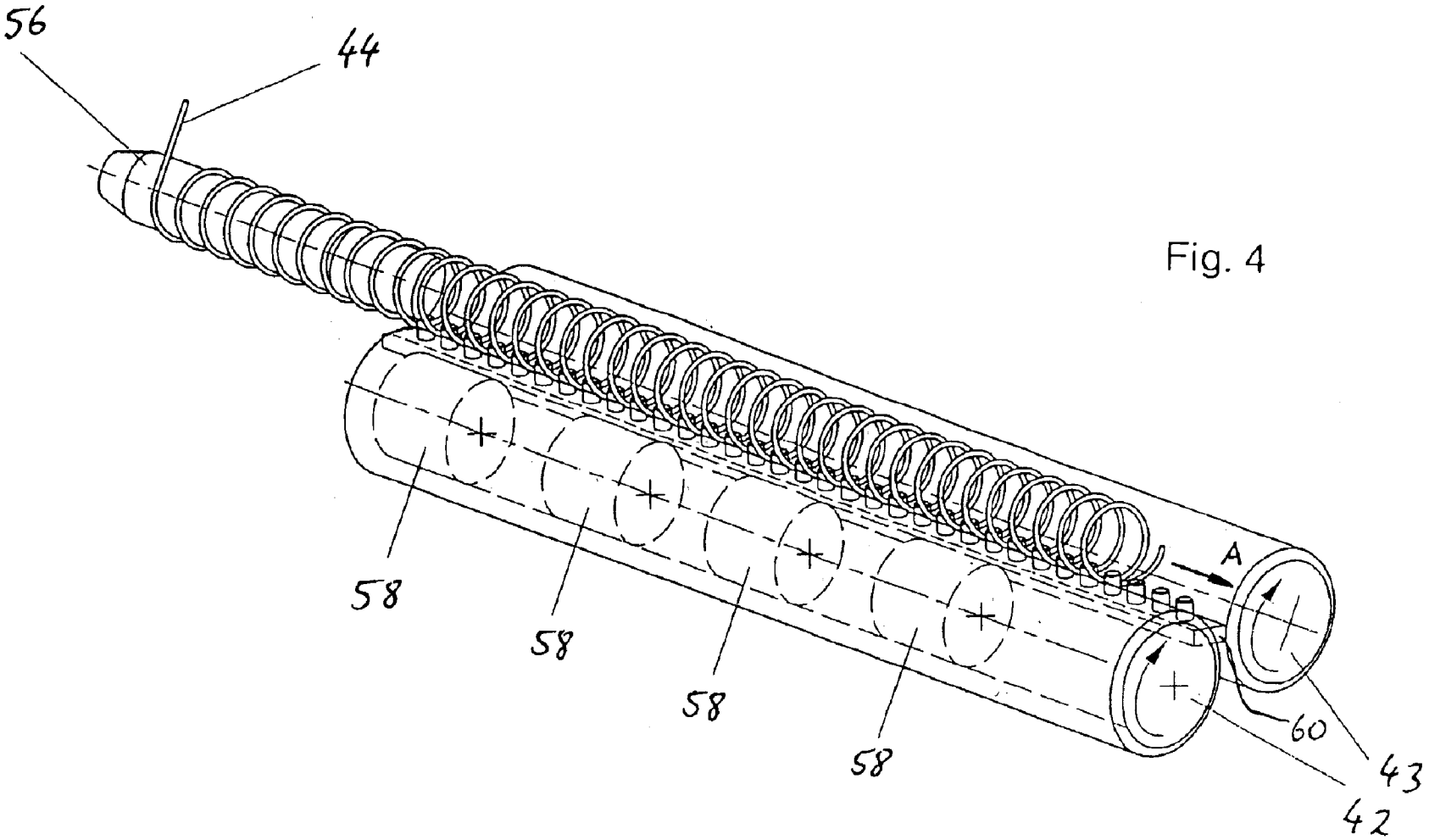
FIG. 4 is a perspective view of one presently preferred guide means which forms part of the structure shown in FIG. 3.

The structure which is shown in FIGS. 3 and 4 further comprises elongated at least substantially cylindrical cores or mandrels 56 (one shown in FIG. 4) which are driven to rotate about their longitudinal axes and to move lengthwise in the directions in and counter to that indicated by the arrow A. The means for rotating each core 56 can include a discrete prime mover or a transmission receiving motion from the prime mover for the rollers 42, 43 or from the prime mover for another mobile component of the apparatus 36 or the production line including the apparatus 36. The diameter of the core 56 is such that it can enter the trailing end of a coil spring 44 and frictionally engages the adjacent (surrounding) convolutions 44*a* so that the coil spring is compelled to share the movements of the core.

The core 56 of FIG. 4 is parallel to the guide rollers 42, 43 and is positioned in such a way that the convolutions of the coil spring 44 surrounding the core contact the peripheral surfaces of the two rollers. The lead or pitch of convolutions 44*a* determines the rotational as well as the axial speed of the core 56, namely the speed at which the convolutions 44*a* of the coil spring 44 are being threaded into the rows of perforations 22 in the spine 21 of a stack 29 located at the station accommodating the apparatus 36. Thus, successive increments of the coil spring 44 advance along a helical path which ensures predictable entry of requisite lengths of the coil spring into the spines 21 of a stack 29 at the threading-in station.

The rollers 42, 43 rotate simultaneously with the coil spring 44 at a speed which is related to the peripheral speed of the coil spring. The arrangement is such that the peripheral speed of the rollers 42, 43 slightly exceeds the peripheral speed of the coil spring 44. This is desirable and advantageous because it entails a slight reduction of the diameters of the convolutions 44*a* which, in turn, ensures that the pitch or lead of the convolutions can better conform to the spacing of holes or perforations 22 in the spine 21 of the stack 29 at the station for the apparatus 36. In addition, the just discussed selection of the peripheral speed of the rollers 42, 43 and of the convolutions 44*a* is desirable on the ground that the mass of that portion of the coil spring 44 which is already threaded into the adjacent stack 29 then located in the apparatus 36 cannot unduly influence (oppose) the threading of the next-following convolutions 44*a* and hence the making of successive convolutions on the rotating core 56. It is to be borne in mind that the coil spring portion surrounding the core 56 tends to reduce its frictional engagement with the peripheral surface of the core, and such undesirable tendency is enhanced by centrifugal force.

If the lead or pitch of the convolutions 44*a* tends to vary (fluctuate), the coil spring 44 can exhibit the tendency to move away from contact with the peripheral surfaces of the guide rollers 42, 43. For example, and as shown in FIG. 5*a*, the convolutions 44*a* at the leader of the advancing coil spring 44 tend to move away from the peripheral surfaces of the guide rollers 42, 43 if the lead or pitch of the coil spring is too small. On the other hand, if the lead or pitch of the coil spring 44 is excessive (see FIG. 5*b*), an intermediate portion 44*b* of the developing and advancing coil spring tends to buckle, i.e., to move away from contact with the adjacent portions of peripheral surfaces of the rollers 42 and 43.

Once the threading of coil springs 44 into the four stacks 29 in the apparatus 36 is completed, the turret 32 is indexed to advance the thus obtained pads, calendars or analogous commodities to the severing station 37 of FIG. 1*b* where the making of the commodities is completed. The end portions of the spirals can be bent and/or otherwise deformed to ensure that they cannot be separated from the respective stacks 29.

In order to reduce the likelihood of undesirable deformation of the coil spring 44 in a manner as shown in FIGS. 5*a* and 5*b*, as well as to prevent further undesirable departures from the optimum shape of the coil spring during the making and/or during threading into the perforations 22 of a stack 29, the improved apparatus 36 comprises magnetic means which is associated with the guide means including the rollers 42, 43. As shown in FIG. 6, the rollers 42, 43 are respectively provided with elongated cylindrical envelopes 42*a*, 43*a* which confine cylindrical permanent magnets 58. The magnets 58 have or can have identical sizes and/or shapes and are spaced apart and preferably equidistant from each other. As can be seen in FIG. 6, each of the intermediate magnets 58 is oriented in such a way that its south pole is adjacent to but spaced apart from the south pole of one of the neighboring magnets and that its north pole is adjacent to but spaced apart from the north pole of the other neighboring magnet. The magnets 58 establish magnetic fields which attract the coil spring 44 in the elongated path being defined by the external surfaces of the envelopes 42*a*, 42*a*. The strengths of the magnetic fields suffice to at least greatly reduce the likelihood of deformations of the type shown in FIGS. 5*a* and 5*b*. The coil spring 44 consists of a ferromagnetic material. It has been found that the utilization of the magnets 58 or analogous magnets contributes significantly to predictable and optimal threading of successive convolutions 44*a* into the groups of registering perforations 22 in the respective stacks 29 of sheets at the threading station accommodating the apparatus 36.

Referring again to FIG. 4, the guide means of the improved apparatus 36 can further comprise an elongated strip-shaped auxiliary guide 60 which is disposed between the rollers 42, 43 and includes a row of equidistant projections 60*a* in the form of studs or pins extending into the path defined by the external surfaces of the rollers. The mutual spacing of the projections 60*a* depends upon the pitch or lead of the coil spring 44 so that each such projection is received between two neighboring convolutions 44*a*. This auxiliary guide and its projections also contribute to predictable (optimum) guidance of the coil spring 44 in the path which is defined by the guide rollers 42, 43 for the coil spring 44.

Figure 5:
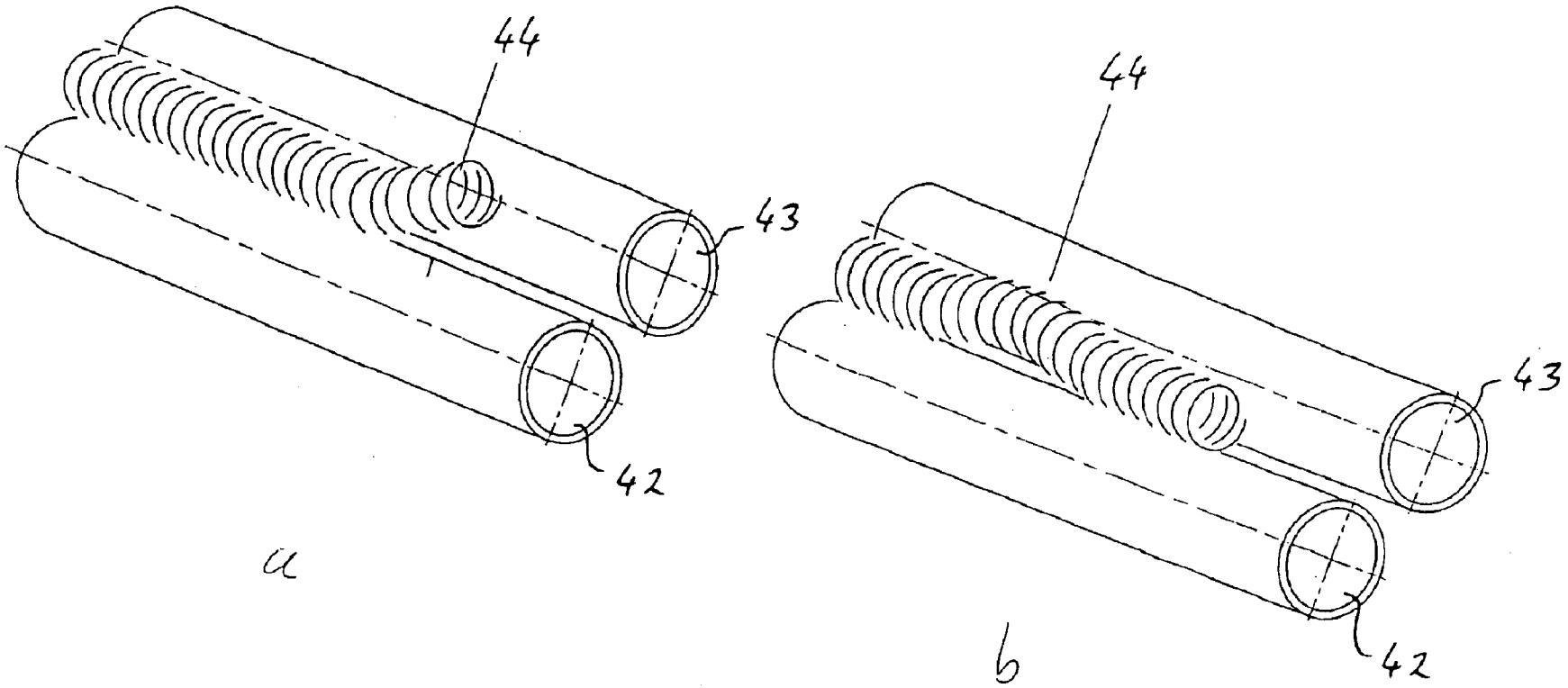
FIG. 5*a* is a smaller-scale perspective view of a portion of the guide means shown in FIG. 4 and of a portion of a continuous coil spring having undergone one type of undesirable deformation due to the absence of magnetic means or adequate magnetic means at the guide means.
FIG. 5*b* shows the structure of FIG. 5*a* and a portion of a coil spring which has undergone a different deformation, again due to the absence of magnetic means or adequate magnetic means at the guide means.
Figure 6:
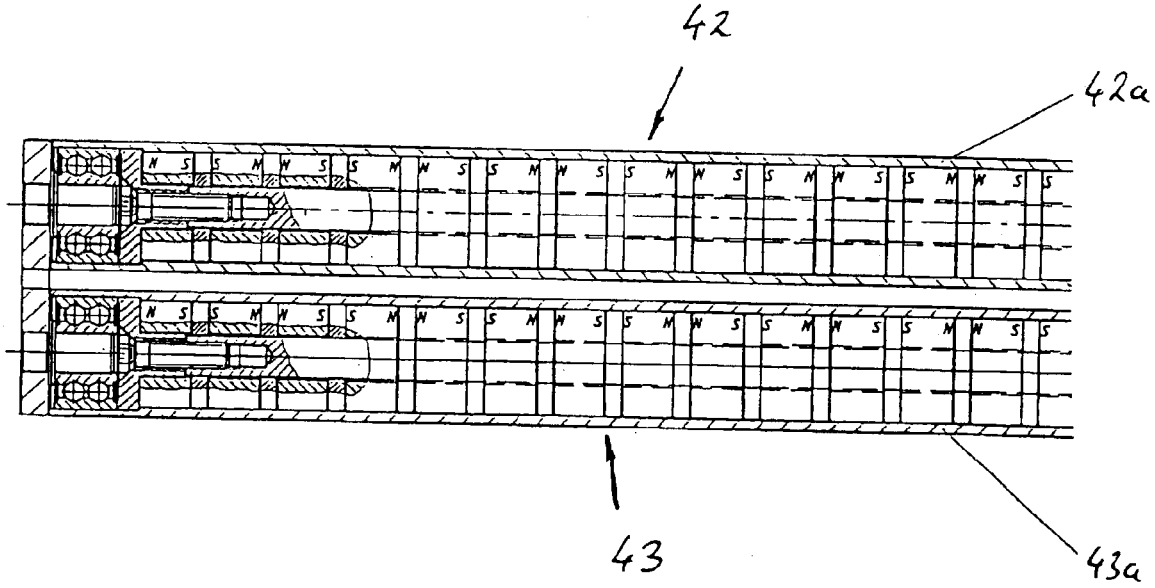
FIG. 6 is a fragmentary longitudinal sectional view of a modified guide means.
Figure 7:
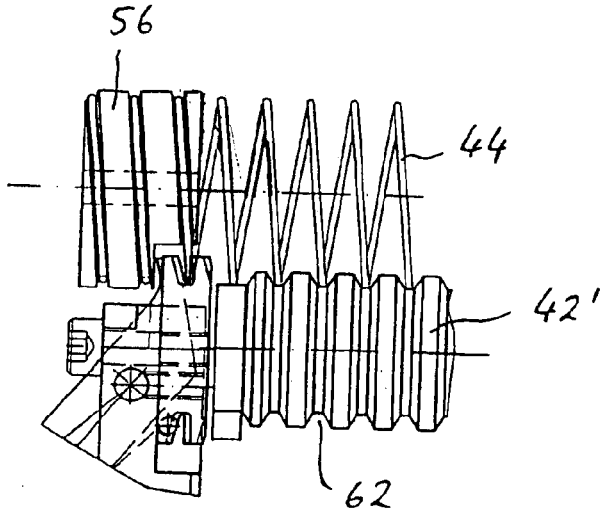
FIG. 7 is a fragmentary elevational view of a further guide means.

The rollers 42, 43 of the guide means shown in FIGS. 4 to 6 have smooth cylindrical peripheral surfaces. However, it is equally within the purview of the invention to provide the external surface of at least one of the guide rollers with means for ensuring even more predictable guidance of successive convolutions 44*a* of the coil spring 44. Thus, and as shown in FIG. 7, at least one (42') of the two guide rollers can be provided with equidistant external circumferentially complete circular grooves 62 for portions of successive convolutions 44*a* of the coil spring 44 which is or which can be formed by and surrounds the mandrel 56. The axial spacing of neighboring grooves 62 in the peripheral surface of the guide roller 42' shown in FIG. 7 corresponds to the desired or preferred lead or pitch of convolutions 44*a* of the coil spring 44. This ensures that the projections 60*a* of the auxiliary guide 60 (not shown in FIG. 7) invariably extend between successive convolutions 4*a* of the coil spring 44 shown in FIG. 7.

The axial spacing of grooves 62 in the peripheral surface of the guide roller 42' shown in FIG. 7 is selected in such a way that portions of the convolutions 44*a* forming part of the coil spring 44 extend into the neighboring grooves 62. Thus, the function of the grooves 62 is the same as or analogous to that of the auxiliary guide 60 of FIG. 4 and its projections 60*a*. The discrete endless grooves 62 in at least one (42') of the two guide rollers can be provided in lieu of or in addition to the auxiliary guide 60 and its projections 60*a*.

It is further within the purview of the present invention to furnish the apparatus 36 with a set of two or more guide rollers 42' having differently spaced-apart endless grooves 62 and/or with two or more auxiliary guides 60 having differently spaced-apart projections 60*a*. This renders it possible to rapidly convert the apparatus 36 for the making and threading of coil springs having different pitches or leads, i.e., for the introduction of magnetic spirals having different pitches or leads into stacks 29 of superimposed sheets having spines 21 provided with rows of perforations 22 having different spacings.

An important advantage of all embodiments of the improved apparatus 36 and of its aforedescribed modifications is that it ensures a highly predictable guidance of the coil spring 44 at the station (i.e., at 36) where the convolutions of such coil spring are to be threaded into the spine of a stack of sheets at the respective station. The magnets 58 can fully compensate for eventual departures of the actual pitch or lead of the coil spring 44 from the desired or optimum pitch. This is accomplished in that the magnets invariably maintain the convolutions 44*a* of the coil spring 44 in optimum positions relative to (such as in continuous contact with) the rollers 42, 43 or 42' of the guide means in the apparatus 36. It has been ascertained that the magnets contribute significantly to predictability of threading of the convolutions 44*a* into the perforations 22 of the stacks 29 in the apparatus 36.

The rollers 42, 43 of the improved apparatus 36 can be said to define for the coil springs 44 an elongated trough-shaped path bounded at least in part by a substantially concave surface. Such surface can be defined by portions of peripheral surfaces of the antimagnetic tubes 42*a*, 43*a* and by that side of the auxiliary guide 60 which confronts the advancing coil spring 44 and is provided with the projections 60*a*. It is also within the purview of the invention to replace the rollers 42, 43 with a trough having a concave surface confronting and being contacted by the convolutions 44*a* of the advancing coil 44. The magnets are then provided in or are adjacent the trough-shaped guide in close proximity to the concave surface.

The rollers 42, 43 can be replaced with stationary cylinders which guide the advancing coil or coils 44. However, it is presently preferred to employ rotary guide rollers because they contribute to predictable guidance of a coil spring 44 while its convolutions 44*a* enter the rows of perforations 22 in a stack 29 then located at the station accommodating the apparatus 36.

It is possible to provide one or more magnets only in one of the guide rollers, e.g., in the roller 42 or 43 of FIG. 4 or 6. The embodiment which is shown in these Figures is preferred at this time because it contributes to more reliable retention of the coil spring 44 in the prescribed path during each stage of advancement of the convolutions 44*a* within the apparatus 36.

An advantage of the aforediscussed feature that the rotational speed of the rollers 42, 43 at least slightly exceeds the rotational speed of the core 56 is that the coil spring 44 is maintained under a longitudinal tensional stress and tends to reduce the diameters of its convolutions 44*a*. This renders it possible to conform the pitch or lead of the coil spring 44 to the mutual spacing of perforations 22 at the spines 21 of the stacks 29 in the apparatus 36. In addition, such arrangement counteracts the tendency of the mass of convolutions 44*a* already extending through the perforations 22 to oppose the introduction of additional convolutions 44*a* into a stack 29 being held in the apparatus 36. Such tendency of the already introduced convolutions is attributable to the reduction of friction with the guide roller(s) and the action of centrifugal force.

The apparatus of the present invention can be combined with the apparatus which is disclosed in the commonly owned copending U.S. patent application Ser. No. filed by Ferdinand Fuchs on March, 2003 for "METHOD OF AND APPARATUS FOR GATHERING STACKS OF SHEETS AND THE LIKE". The apparatus which is disclosed in the aforesaid copending U.S. patent application serves to conform the shapes of holes in the spines of stacked sheets, panels foils or the like to the curvatures of convolutions of the coil spring prior to introduction of convolutions into the holes. This is accomplished in that at least some sheets or foils or panels of each stack are shifted relative to each other on their way to the locus of threading the convolutions of the coil spring into the perforated spine(s) of the stack(s) in the apparatus 36. The apparatus of the copending application can be installed at the station 33 or 34 shown in FIG. 1*b* of the present application. As already mentioned hereinbefore, the commonly owned copending patent application is incorporated herein by reference; this applies also for the prior art which is identified in the copending application.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of couplings stacked sheets by spirals or the like and, therefore, such adaptations should and are intended to be comprehended within the meaning and range of equivalence of the appended claims.

What is claimed is:

1. Apparatus for introducing the convolutions of magnetic spirals into elongated rows of registering successive holes in stacks of superimposed sheets, comprising:

guide means defining for the spirals a path extending longitudinally of the rows of holes;

means for threading the convolutions of the spirals in a predetermined direction into successive holes of rows in the respective stacks; and magnetic means associated with said guide means for maintaining the spirals in said path, wherein said guide means includes at least one elongated rotary roller extending lengthwise of said path, said magnetic means being associated with said at least one roller, and wherein said at least one roller comprises at least a portion of said magnetic means.

2. The apparatus of claim 1, wherein said guide means defines an elongated trough-shaped path bounded at least in part by a concave surface.

3. The apparatus of claim 1, wherein said guide means includes a plurality of at least substantially parallel elongated rotary rollers extending lengthwise of said path, and means for rotating said rollers in the same direction and at least substantially at identical speeds, said magnetic means being associated with at least one of said rollers.

4. The apparatus of claim 3 for introducing magnetic spirals each having a predetermined diameter, said rollers including first and second rollers spaced apart from each other a distance less than said predetermined diameter.

5. The apparatus of claim 1, wherein said means for threading comprises an elongated core surrounded by some convolutions of the spirals upstream of said path as seen in said predetermined direction.

6. The apparatus of claim 1, wherein said magnetic means comprises at least one row of successive neighboring magnets extending longitudinally of said path, said neighboring magnets of said at least one row having identical poles adjacent each other.

7. The apparatus of claim 6, wherein the magnets of said at least one row are at least substantially identical with each other.

8. The apparatus of claim 6, wherein the magnets of said at least one row are at least substantially equidistant from each other.

9. The apparatus of claim 1, wherein said magnetic means includes a plurality of magnets confined in said guide means, said guide means including at least one antimagnetic envelope at least partially confining said plurality of magnets.

10. The apparatus of claim 9, wherein said at least one envelope includes a tube and the magnets of said plurality form a row of spaced-apart magnets in said tube.

11. The apparatus of claim 1, wherein said guide means includes at least one elongated roller having an external helical groove for portions of convolutions of spirals in said path.

12. The apparatus of claim 1, further comprising means for stacking the sheets and means for supplying stacked sheets to said path.

13. The apparatus of claim 1, wherein said guide means comprises at least one elongated auxiliary guide bounding a portion of said path and having a series of projections extending between the convolutions of a spiral in said path.

14. Apparatus for introducing the convolutions of magnetic spirals into elongated rows of registering successive holes in stacks of superimposed sheets, comprising:

guide means defining for the spirals a path extending longitudinally of the rows of holes;

means for threading the convolutions of the spirals in a predetermined direction into successive holes of rows in the respective stacks; and magnetic means associated with said guide means for maintaining the spirals in said path, wherein at least some of the sheets consist of paper and the spirals consist of a metallic material, wherein said guide means includes at least one elongated rotary roller extending lengthwise of said path, said magnetic means being associated with said at least one roller, and wherein at least a portion of said magnetic means is confined in said at least one roller.

15. The apparatus of claim 14, wherein said magnetic means comprises a plurality of discrete magnets in said at least one roller.

16. Apparatus for introducing the convolutions of magnetic spirals into elongated rows of registering successive holes in stacks of superimposed sheets, comprising:

guide means defining for the spirals a path extending longitudinally of the rows of holes;

means for threading the convolutions of the spirals in a predetermined direction into successive holes of rows in the respective stacks;

magnetic means associated with said guide means for maintaining the spirals in said path, wherein at least some of the sheets consist of paper and the spirals consist of a metallic material, and wherein said means for threading comprises an elongated core surrounded by some convolutions of the spirals upstream of said path as seen in said predetermined direction; and further comprising means for rotating said core and for advancing the core lengthwise in said predetermined direction.

17. The apparatus of claim 16, wherein said core includes an at least substantially cylindrical mandrel.

18. Apparatus for introducing the convolutions of magnetic spirals into elongated rows of registering successive holes in stacks of superimposed sheets, comprising:

guide means defining for the spirals a path extending longitudinally of the rows of holes;

means for threading the convolutions of the spirals in a predetermined direction into successive holes of rows in the respective stacks; and magnetic means associated with said guide means for maintaining the spirals in said path, wherein at least some of the sheets consist of paper and the spirals consist of a metallic material, wherein said means for threading comprises an elongated core surrounded by some convolutions of the spirals upstream of said path as seen in said predetermined direction, and wherein said means for rotating is arranged to rotate said core at a first speed and said guide means includes at least one elongated rotary roller and means for rotating said at least one roller at a second speed greater than said first speed.

* * * * *